US007175153B2

(12) United States Patent
Schreyer et al.

(10) Patent No.: US 7,175,153 B2
(45) Date of Patent: Feb. 13, 2007

(54) POSITIONING AID

(75) Inventors: Bernd Schreyer, Hockenheim (DE); Klaus Schneiders, Hohentann (DE); Felix Von Limburg, Magdeburg (DE); Thomas Laudan, Unseburg (DE)

(73) Assignee: BT Baubedarf Magdeburg GmbH, Magdeburg (DE)

( * ) Notice: Subject to any disclaimer, the term of this patent is extended or adjusted under 35 U.S.C. 154(b) by 327 days.

(21) Appl. No.: 10/497,979

(22) PCT Filed: Dec. 4, 2002

(86) PCT No.: PCT/EP02/13740

§ 371 (c)(1),
(2), (4) Date: Jun. 3, 2004

(87) PCT Pub. No.: WO03/047829

PCT Pub. Date: Jun. 12, 2003

(65) Prior Publication Data

US 2005/0133681 A1 Jun. 23, 2005

(30) Foreign Application Priority Data

Dec. 6, 2001 (DE) ..... 101 59 902

(51) Int. Cl.
*B28B 7/00* (2006.01)

(52) U.S. Cl. ..... 249/139; 249/163; 249/169; 249/187.1; 425/DIG. 33

(58) Field of Classification Search ..... 249/139, 249/163, 169, 187.1, 205; 425/3, DIG. 33; 52/127.1, 127.5, 127.7
See application file for complete search history.

(56) References Cited

U.S. PATENT DOCUMENTS 6,547,209 B1 * 4/2003 Vappula ..... 249/139
2001/0004819 A1 * 6/2001 Reymann ..... 52/426

FOREIGN PATENT DOCUMENTS

| | | |
|---|---|---|
| DE | 44 24 447 | 12/1995 |
| DE | 295 17 298 | 1/1996 |
| DE | 195 28 842 | 2/1997 |
| DE | 100 02 993 | 6/2000 |

(Continued)

*Primary Examiner*—Donald Heckenberg
(74) *Attorney, Agent, or Firm*—Flynn, Thiel, Boutell & Tanis, P.C.

(57) ABSTRACT

A positioning aid for a magnetic device used for positioning a shuttering means, the magnetic device being movable between a position of use, in which said magnetic device is in contact with a ferromagnetic shuttering support, and a position of non-use, in which said magnetic device is spaced apart from the shuttering support, said positioning aid comprising at least one retaining device relative to which the magnetic device is supported against a holding force of said magnetic device, and further comprising at least one elastic support unit for producing a lifting force against said holding force so as to hold the magnetic device in the position of non-use. In order to be able to provide such positioning aids with a more compact structural design and to use them more universally, the present invention is so conceived that the magnetic device is firmly connected to the retaining device and that, at least in the position of non-use, the support unit is arranged between the retaining device and the shuttering support, at least along certain sections thereof.

36 Claims, 7 Drawing Sheets

FOREIGN PATENT DOCUMENTS

| | | | |
|---|---|---|---|
| DE | 100 02 993 | A1 * | 7/2000 |
| DE | 201 05 709.3 | | 3/2001 |
| DE | 202 06 576 | | 8/2002 |
| EP | 0 512 437 | A1 * | 11/1992 |
| EP | 0 842 339 | | 5/1998 |
| EP | 1 086 792 | | 3/2001 |
| FR | 2 126 633 | | 10/1972 |
| FR | 2 538 049 | | 6/1984 |

* cited by examiner

POSITIONING AID

FIELD OF THE INVENTION

The present invention relates to a positioning aid for a magnetic device used for positioning a shuttering means, the magnetic device being movable between a position of use, in which said magnetic device is in contact with a ferromagnetic shuttering support, and a position of non-use, in which said magnetic device is spaced apart from the shuttering support, said positioning aid comprising at least one retaining device relative to which the magnetic device is supported against a holding force of said magnetic device, and further comprising at least one elastic support unit for producing a lifting force against said holding force so as to hold the magnetic device in the position of non-use.

BACKGROUND OF THE INVENTION

Such a positioning aid for magnetic devices used for positioning a shuttering means is known e.g. from EP 0 842 339. The magnetic device consists here of a permanent magnet accommodated in a retaining device. The retaining device is integrated in shuttering parts of the shuttering system and is provided with a lift-off bow which extends over the magnet from one side to the other and which rests on the shuttering support. A spring, which forms the support unit and which applies the lifting force to the magnet, is located between the retaining device and the magnetic device at a position above said magnetic device. At the position of use, the magnet is in contact with the ferromagnetic shuttering support. Due to the holding force of the magnet on the shuttering support, a displacement of the magnet is prevented so that the magnet can be used for positioning the shuttering parts on the shuttering support. The holding force of the magnet overcomes the lifting force of the spring. If the magnet is to be displaced, the magnet is lifted off from the shuttering support by means of a lifting screw. As soon as the magnet is spaced apart from the shuttering support, the holding force applied by the magnet to the shuttering support decreases strongly. At the position of non-use, i.e. in the raised condition of the magnet, the lifting force of the spring is dimensioned such that it overcomes the residual holding force between the magnet and the shuttering support and the weight of the magnet itself, so that the magnet will remain at the position of non-use. The positioning aid can then be displaced to a new site. For fixing the positioning aid to the shuttering support, the magnet is forced towards the shuttering support, until the holding force and the weight of the magnet overcome the lifting force of the spring and the magnet moves automatically into contact with the shuttering support. The force for returning the magnet from its position of non-use to the position of use can be applied e.g. by a blow on the retaining device.

The known positioning aid proves to entail rather a high expenditure, with regard to space requirements as well as with regard to production costs. In addition, it cannot be used in a flexible manner, since the field of use is determined by the magnet provided. If finer contours are to be delimited on the shuttering support by the shuttering elements, or if strong holding forces are required for comparatively large shuttering elements, it is often impossible to use the known positioning aids.

It is therefore the object of the present invention to provide an economy-priced solution for positioning aids, which can be used universally.

SUMMARY OF THE INVENTION

The object of the present invention is achieved in that the magnetic device is firmly connected to the retaining device and that, at least in the position of non-use, the support unit is arranged between the retaining device and the shuttering support, at least along certain sections thereof.

This solution is simple and has the advantage that the support unit need no longer be arranged above the magnetic device, whereby the construction height of the positioning aid will be reduced substantially. The support unit can now be laterally attached to the magnetic device. This means that the field of use of the positioning aid will no longer be limited by the structural design of the lift-off bow either. It will therefore be possible to adapt the retaining device to the dimensions of the magnetic device.

In this connection, it may be advantageous when at least two spaced-apart retaining devices are provided, which each have associated therewith at least one support unit. This will allow an adaptation of the retaining devices to magnetic devices having different dimensions, after the fashion of a building set.

It can be of advantage when the retaining devices are arranged on opposed sides of the magnetic device. A uniform support of the magnetic device can be realized in this way.

It may also prove to be advantageous when four retaining devices are provided. Also this provides the possibility of realizing a uniform support of the magnetic device. When the magnetic device is substantially quadrangular when seen from above, a very uniform support of the magnetic device on all four sides thereof can be realized. Especially in the case of very long, essentially rectangular magnetic devices, a structural design of this kind may prove to be advantageous so as to avoid tilting.

According to an advantageous further development of the present invention, two respective retaining devices can be associated with one side of the magnetic device. Also this provides the possibility of realizing a uniform support of the magnetic device. The retaining devices can here be provided close to the corners of a magnetic device, which is quadrangular or rectangular when seen from above. It may then be of advantage to provide the retaining devices on the longer sides of a magnetic device, which is rectangular when seen from above.

The retaining devices can be interconnected such that they are adapted to be moved to spaced-apart positions via associated adjusting means, so that said retaining devices can be mounted on and adapted to the respective magnetic devices more easily. The retaining devices can be adapted more easily to the respective magnetic devices in this way.

It may also prove to be advantageous when two retaining devices are rigidly interconnected. It will be possible to achieve a more stable connection between the retaining devices in this way. In this case, two respective ones of four retaining devices can be rigidly interconnected, so as to form two retaining elements.

In addition, it may prove to be advantageous when the retaining devices, together with the adjusting means, form a holding frame which surrounds the magnetic device. Also this allows a safe connection to be realized between the magnetic device and the retaining device.

In order to make the retaining devices and the magnetic device more easily replaceable, the retaining devices can be adapted to be releasably connected to the magnetic device.

It may also prove to be advantageous when the magnetic device has essentially the shape of a parallelepiped and when the bottom side thereof faces the shuttering support. In the case of such simple-geometry magnetic devices, an adaptation of the retaining devices to the magnetic device can easily be realized.

It may also be of advantage when the retaining device is adapted to be attached to one of the side faces of the magnetic device. A positioning aid having a particularly low construction height can be realized in this way.

In special cases of use, it may also be of advantage when the retaining device is attached to an upper side of the magnetic device, said upper side facing away from the shuttering side.

In order to facilitate the mounting of the retaining devices on the magnetic device, said retaining devices may include reception means which are engaged by the magnetic device.

In this respect, it may of advantage when the magnetic device is adapted to be inserted into said reception means. The magnetic devices and the reception means can then simply be inserted into one another and secured in position relative to one another e.g. by simple headless screws. This will make mounting much easier.

In addition, it may prove to be advantageous when the retaining device is attached to the magnetic device by means of a screw connection. A reliable connection between the magnetic device and the retaining device can be guaranteed in this way.

According to an advantageous further development of the present invention, a lift-off means can be provided, with the aid of which the magnetic device can be transferred from its position of use to its position of non-use. The magnetic device can thus be lifted off more easily.

It may also be of advantage, when the lift-off means is attached to the magnetic device. In this case, it will not be necessary to attach the lift-off means to the retaining device so that the structural design of the retaining device can be simplified. In addition, the whole positioning aid can be rendered more compact.

A particularly simple and nevertheless effective lift-off means can be provided, when the lift-off means comprises an eccentric which is adapted to be brought into engagement with the shuttering support, so as to transfer the magnetic device from the position of use to the position of non-use.

In this case, it may be of advantage when a lever is provided for operating the lift-off means. Also this allows a very simple lift-off means to be realized.

It may also be advantageous when the lever and the eccentric are firmly interconnected and rotatably supported on the magnetic device.

Furthermore, it may prove to be advantageous when the eccentric is arranged such that it is located closer to one side of the magnetic device than to the side located opposite said first-mentioned side. The eccentric will therefore produce an asymmetric effect when the magnetic device is lifted off. The forces that have to be applied for lifting off the magnetic device can be reduced in this way.

In accordance with an advantageous embodiment of the present invention, the support unit can be provided with an elastic spring element for producing the lifting force. A very simple support unit can be realized in this way.

According to one embodiment, the elastic spring element can be a compression spring. Compression springs allow strong forces and they are economy-priced components.

Alternatively, the elastic spring element can comprise an elastomer. Making use of elastomers, very simple and economy-priced spring elements can be realized.

According to an advantageous further development, the elastomer can be a rubber. Also this material is suitable for realizing permanently elastic spring elements at a reasonable price.

Alternatively, the elastic spring element can comprise a plastic spring. The support unit and the retaining device can then be designed in a weight-reducing manner.

A particularly compact structural design of the positioning aid can be achieved, when the elastic spring element is a bending sheet whose end portion is laterally spread by sliding on the shuttering support during transfer from the position of non-use to the position of use.

According to an advantageous further development of the present invention, the support unit can include a rest-on means, which is displaceably supported in the retaining device and which rests on the shuttering support at least at the position of non-use, the spring means being accommodated between the rest-on means and the retaining device. This allows the support unit to be designed after the fashion of a piston-cylinder unit, in which the rest-on means defines a displaceable piston.

It may by of advantage when the rest-on means is substantially pot-shaped and when the reception means of the retaining device has the shape of a cylinder jacket. Having this kind of structural design, the reception means can simultaneously be used as a guide element for the spring means.

In order to improve the operational dependability, the rest-on means can be captively connected to the retaining device.

In order to achieve the highest possible supporting forces, the spring force of the spring means can be adjustable. In this connection, it may prove to be advantageous when an adjusting screw is provided for adjusting the spring force. Such a screw provides a simple possibility of adjustment. It is also imaginable that the spring means itself is provided with an adjusting thread. It will then be possible to carry out the adjustment by rotating the spring means itself. The retaining device must in this case be provided with a reception means having a threadlike structural design.

According to an advantageous further development of the present invention, the retaining device can be integrated in the magnetic device. A particularly compact structural design comprising the positioning aid together with the magnetic device can be realized in this way.

In this case, it may prove to be advantageous when the retaining devices are formed by holes in the magnetic device. This allows a very simple structural design of the retaining device.

It may also be of advantage, when the retaining device is connected to the magnetic device by means of an adhesive. A particularly simple and economy-priced structural design can be realized in this way.

According to the present invention, a building set is additionally claimed, which comprises a positioning aid according to the present invention and a magnetic device.

Likewise, a shuttering means is claimed, which is provided with a positioning aid according to the present invention.

In this respect, it may be of advantage when the shuttering means and the retaining device are formed integrally with on another. The retaining device can then be produced together with the shuttering means in one operating cycle.

In addition, it may be of advantage when the magnetic device and the shuttering means are firmly interconnected. A stable and compact structural design of the shuttering means and of the magnetic device will be obtained in this way. In addition, the magnet can then be anchored reliably in the shuttering means.

Furthermore, it may prove to be advantageous when, at the position of non-use, the shuttering means is spaced apart from the shuttering support. The shuttering means can then easily be displaced on a shuttering support and moved to a predetermined position. The shuttering means will then only rest on one or on a plurality of support units.

In order to achieve the best possible result as far as the finished prefabricated concrete components are concerned, it may prove to be advantageous when, at the position of use, the shuttering means and the retaining device, respectively, rest on the shuttering support.

BRIEF DESCRIPTION OF THE DRAWINGS

In the following, the present invention will be explained in detail making reference to a plurality of embodiments.

DETAILED DESCRIPTION

Figure 1:
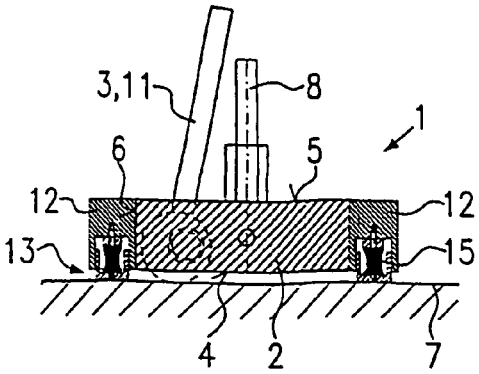
FIG. 1 shows a first embodiment of the positioning aid according to the present invention in a sectional view along line I—I of FIG. 3, the magnetic device being at the position of non-use.

FIG. 1 shows a positioning aid 1 according to the present invention together with a magnetic device 2 having a lift-off means 3 provided thereon. The positioning aid 1 forms together with the magnetic device 2 a building set and these two components may also form a shuttering element.

The magnetic device 2 is a permanent magnet having essentially the shape of a parallel-epiped and comprising a substantially flat bottom side 4 and an upper side 5 that is parallel to said bottom side 4 and, between said upper side and said bottom side, side faces 6 which are arranged at right angles to one another. When seen from above, the magnetic device is substantially square in shape.

At a position of use of the magnetic device 2, the bottom side 4 of said magnetic device 2 is in contact with a ferromagnetic shuttering support 7.

Figure 2:
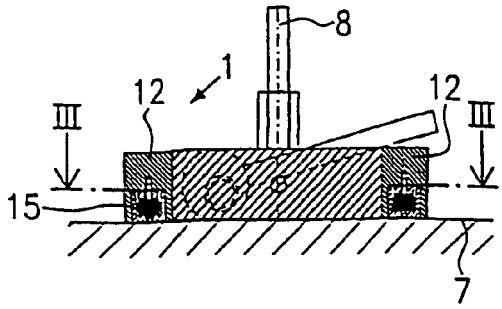
FIG. 2 shows the positioning aid of FIG. 1, the magnetic device being at the position of use.

The position of use is shown in FIG. 2. At a position of non-use, the shuttering support 7 and the bottom side 4 are spaced apart, as can be seen in FIG. 1.

The upper side 5 has provided thereon a rod-like handling device 8 by means of which the magnetic device 2 can be displaced on the shuttering support 7, provided that the magnetic device 2 is at the position of non-use. This handling device 8 can also be used for transferring the magnetic device 2 from the position of non-use to the position of use.

Figure 3:
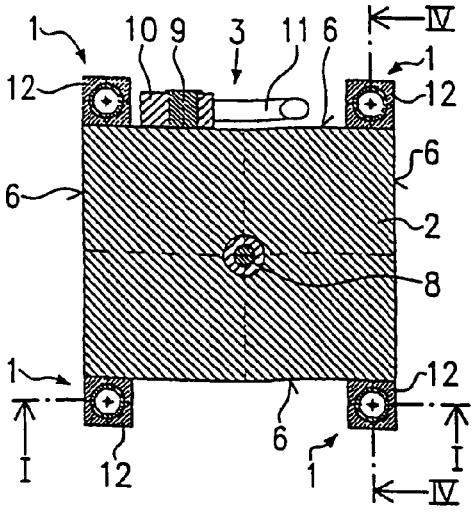
FIG. 3 shows the positioning aid of FIG. 1 in a sectional top view along line lll—lll of FIG. 2.
Figure 4:
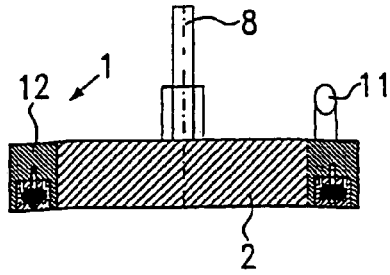
FIG. 4 shows the positioning aid of FIG. 1 in a sectional view along line IV—IV.

One of the side faces 6 of the magnetic device 2 has provided thereon a bearing pin 9, an eccentric 10, which has a lever 11 attached thereto, being pivotably rotatable on said bearing pin 9. In the representation of FIG. 1, the eccentric is in engagement with the shuttering support 7, the magnetic device 2 being in this condition transferable from its position of use to its position of non-use by operating the lever 11. As can especially be seen in the representation of FIG. 3, the bearing pin 9 is located comparatively close to the left end of the associated side face 6 so that the eccentric is adapted to be brought into engagement with the shuttering support 7 essentially in one corner of the magnetic device.

The magnetic device 2 has additionally attached thereto four retaining devices 12, two respective retaining devices 12 being associated with one side face 6. The retaining devices 12 are arranged on opposed sides of the magnetic device 2. The retaining devices 12 can be attached to the magnetic device 2 e.g. by means of a screw connection, not shown, or by means of an adhesive. The retaining devices 12 can, in particular, be releasably connected to the magnetic device 2. When the positioning aid is in operation, the retaining devices 12 are, however, rigidly connected to the magnetic device 2.

Each of the retaining devices 12 is provided with a support unit 13 comprising a pot-shaped rest-on means 14 and a spring means 15. The rest-on means 14 is provided with a cylindrical outer surface 16 which is accommodated in a cylindrical inner surface 17 of the retaining device 12 in an axially displaceable manner. The spring unit 15 comprises an elastomeric spring element 18 made of rubber and having respective threaded bolts 19 and 20 at both ends thereof, the threaded bolt 19 being received in a tapped hole 21 of the rest-on means 14 and the threaded bolt 20 being received in a tapped hole 22 of the retaining device 12. The rest-on means 14 and the spring element 18 are captively connected to the retaining device 12 in this way.

Figure 5:
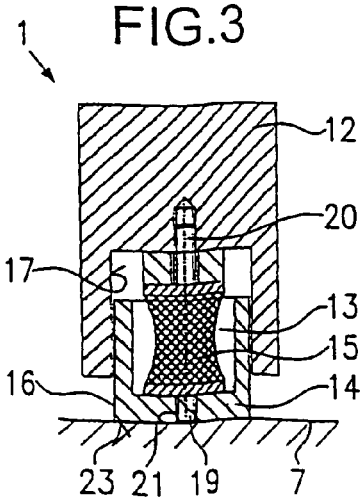
FIG. 5 shows the retaining device and the support unit in an enlarged representation according to FIG. 1.

FIG. 5 shows the support unit 13 in a condition in which the magnetic device 2 is at a position of non-use. This has the effect that the rest-on means 14 with the rest-on surface 23 projects beyond the retaining device 12. The rest-on surface 23 rests on the shuttering support 7 in this condition.

Figure 6:
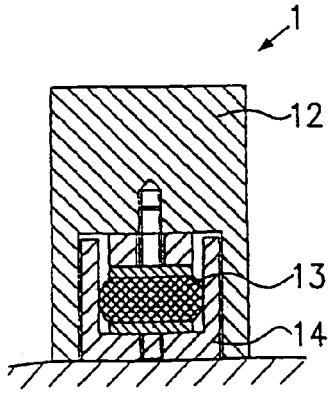
FIG. 6 shows the retaining device and the support unit of FIG. 5 in a representation according to FIG. 2.

FIG. 6 shows a condition of the support unit 13 in which the magnetic device 2 is at its position of use. The spring means 15 is compressed at the position of use of the magnetic device 2.

The spring means 15 works as a compression spring, i.e. it produces a lifting force which counteracts the holding force of the magnet at its position of use. At the position of use of the magnetic device, the lifting force is, however, much weaker than the holding force of the magnetic device. The magnetic device 2 is therefore in firm contact with the shuttering support 7. At the position of non-use, the magnetic device 2 is spaced apart from the shuttering support 7 so that the holding force produced by the magnet has been reduced substantially. The lifting force applied by the spring means 15 is dimensioned such that, at the position of non-use of the shuttering support 7, the lifting force is stronger than the residual holding force of the magnetic device 2 and the weight of the magnetic device 2 so that the holding force will suffice to hold the magnetic device 2 at the position of non-use.

The spring means may also be designed such that, at the position of non-use, only the rest-on means projects beyond the bottom side of the magnetic device and the spring means ends above the bottom side of the magnetic device. The spring means is then arranged only laterally of the magnetic device. Preferably, however, also the spring means should end below the bottom side of the magnetic device at the position of non-use. In this way, the more compact structural design of the positioning aid according to the present invention will be obtained.

In the following, the mode of operation of the present invention will be explained in detail:

For producing a shuttering with shuttering elements, the positioning aid, together with the magnetic device 2, is displaced on the shuttering support 7 to the desired position, the magnetic device 2 occupying the position of non-use. As soon as the desired position has been reached, a pressure force acting in the direction of the shuttering support 7 is applied to the handling device 8; this pressure force overcomes the holding force, and the magnetic device 2, together with the retaining device, is transferred from its position of non-use to its position of use. In the course of this process, the spring elements 18 in the spring means 15 are compressed. The shuttering elements can then be connected to the positioning aid or the magnetic device 2 so as to finish the shuttering.

For detaching the magnetic device 2, the lever 11 is operated so as to rotate the eccentric 10 so that said eccentric will come into engagement with the shuttering support 7. When the lever is moved anticlockwise in the representations shown in FIGS. 1 and 2, the eccentric 10 will produce a detaching force which will release the magnetic device from the shuttering support 7. Since the holding force decreases disproportionately as the distance between the magnetic device and the shuttering support 7 increases, it proves to be effective to lift first one corner of the magnetic device 2 with the aid of the lift-off means 3. This has the effect that the holding force of the magnet decreases substantially so that the lifting force of the spring means will suffice to transfer the magnetic device 2 from its position of use to its position of non-use. The positioning aid 1, together with the magnetic device 2, can then be displaced to some other position on the shuttering support 7. In the course of this process, an operator can handle the positioning aid 1 via the handling device 8.

Due to the structural design of the retaining devices 12, the positioning aid can be given a very compact design. In addition, due to the fact that the retaining device 12 is designed such that it has smooth surfaces, it offers to the user an easily discernible positioning aid. The lower edge of the retaining device 12, for example, is located only slightly above the shuttering support 7 at the position of non-use of the magnetic device 2, so that the positioning aid and thus the magnetic device 2 can be positioned and aligned precisely e.g. along a predetermined line. Since a plurality of individual retaining devices 12 is provided, the retaining devices can be attached to magnetic devices 2 having different dimensions. It is imaginable to provide larger magnetic devices 2 with a higher number of retaining devices 12. It is also imaginable to provide the retaining devices 12 at different locations of the magnetic device 2, if this should be necessary in view of the given spatial conditions. The retaining devices 12 can therefore be attached to the magnetic device such that they are spaced apart more widely or at a small distance from one another. Hence, a building set can be created, which consists of magnetic devices 2 having different dimensions and strengths and of a plurality of retaining devices 12. This allows the positioning aid to be designed individually.

Figure 7:
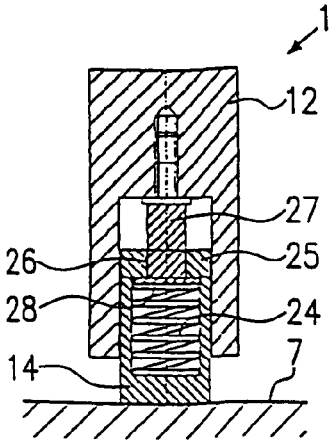
FIG. 7 shows a second embodiment of the retaining device and of the support unit at the position of non-use of the magnetic device.
Figure 8:
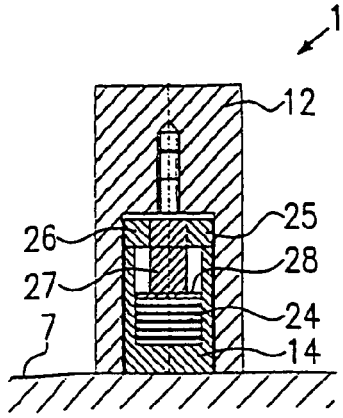
FIG. 8 shows the retaining device and the support unit of FIG. 8 at the position of use of the magnetic device.

In the following, a second embodiment of the present invention will be explained in detail making reference to FIG. 7 and FIG. 8. In order to avoid repetitions, identical elements will be designated by identical reference numerals and only the differences existing in comparison with the first embodiment will be explained.

In the second embodiment, compression springs 24 made of steel or of plastic material are used instead of the spring elements 18. In FIG. 7, the retaining device with the support unit is shown in the condition in which the magnetic device 2 occupies the position of non-use. In FIG. 8, the magnetic device 2 occupies the position of use, so that the compression springs 24 are compressed. The rest-on means 14 is provided with a cover 25 having a hole 26 through which a rod-shaped member 27 extends, the rod-shaped member 27 having a stop 28 provided thereon. The rod-shaped member 27 is fixedly attached to the retaining device 12 by means of a screw connection. The stop 28, together with the cover 25, prevents the rest-on means 14 from becoming detached from the retaining device 12.

Figure 9:
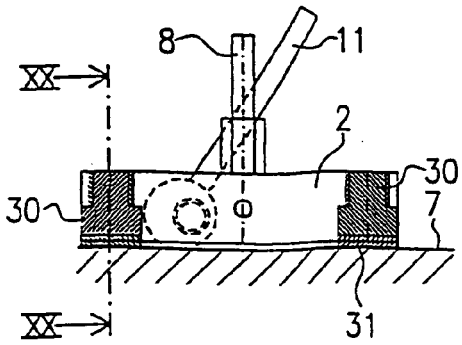
FIG. 9 shows a third embodiment of the positioning aid in a side view, the magnetic device being at the position of non-use.
Figure 10:
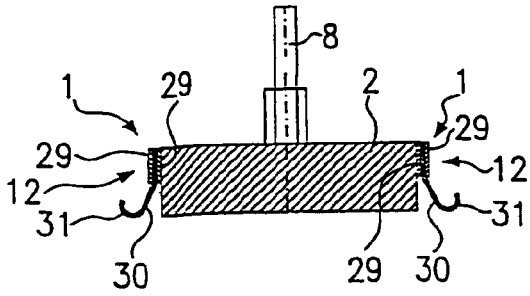
FIG. 10 shows the positioning aid of FIG. 9 in a sectional view along line X—X, the magnetic device being at the position of use.
Figure 11:
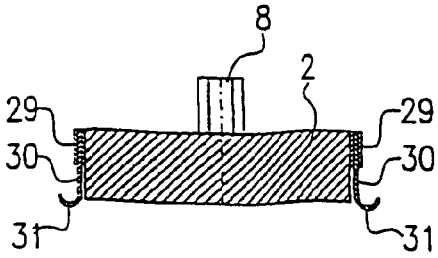
FIG. 11 shows a sectional view of the positioning aid of FIG. 9 along line X—X, the magnetic device being at the position of non-use.
Figure 12:
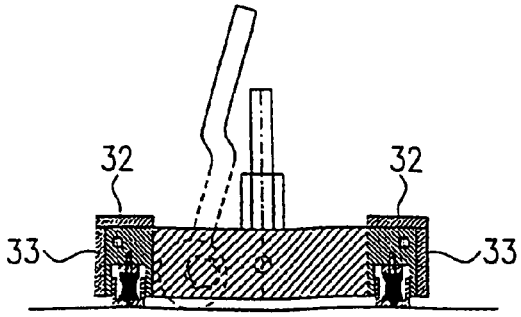
FIG. 12 shows a fourth embodiment of the positioning aid in a representation corresponding to that of FIG. 1.
Figure 13:
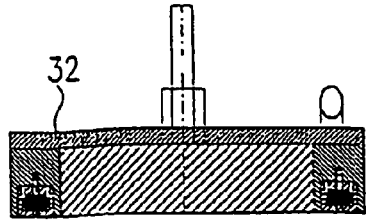
FIG. 13 shows the positioning aid of FIG. 12, the magnetic device being at the position of use.
Figure 14:
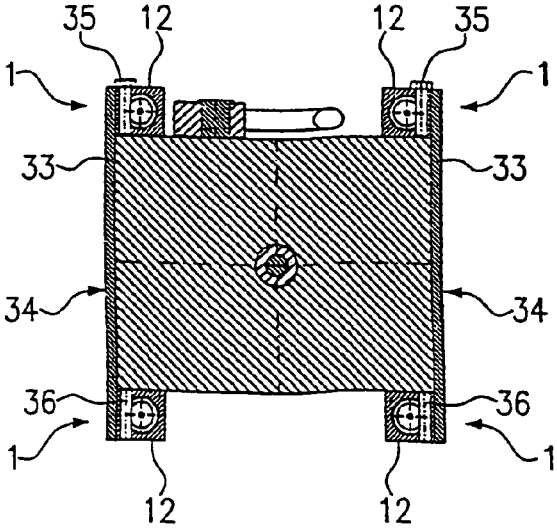
FIG. 14 shows a representation of the positioning aid of FIG. 12 corresponding to the representation in FIG. 3.

FIGS. 9, 10 and 11 describe a third embodiment of the present invention. Also in this case, identical components are designated by identical reference numerals so as to avoid repetitions. Only the differences will be explained.

In contrast to the first embodiment, the retaining device 12 of the third embodiment comprises plate-shaped elements 29, which are attached to the magnetic device 2 and which accommodate between them a spring steel sheet 30 that extends vertically towards the shuttering support 7. As can be seen from FIGS. 10 and 11, end sections 31 of said spring steel sheets are laterally spread when the magnetic device is being transferred from its position of non-use to its position of use according to FIG. 10. Due to this deformation, they produce the necessary lifting force. In so doing, the end sections 31 slide on the shuttering support 7. In the position of non-use, the retaining device rests via the respective end sections 31 of the spring steel sheets 30 on the shuttering support 7.

When the spring elements are designed in this way, the structural design in question will be very reasonable in price.

Figure 15:
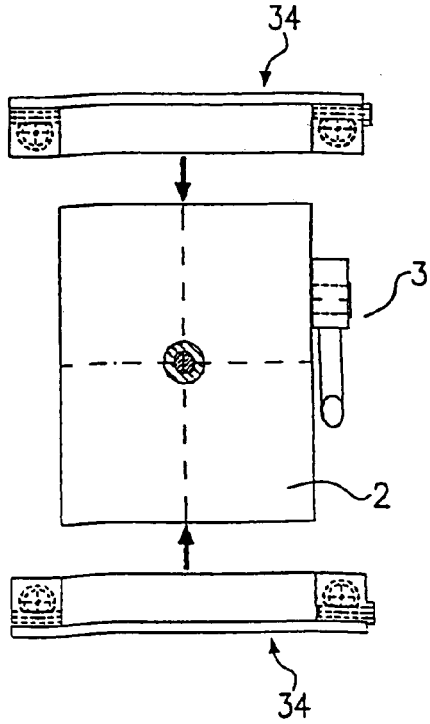
FIG. 15 shows a mounting representation of the positioning aid of FIG. 12.

FIGS. 12, 13, 14 and 15 show a fourth embodiment of the present invention. The mode of operation corresponds to that of the first embodiment. Also the spring elements are designed in the same way. In contrast to the first embodiment, connection plates 32 and 33 are, however, provided between two respective retaining devices 12, each of said connection plates 32 and 33 connecting two retaining devices 12. A combination of connection plates 32, 33 and retaining devices 12 defines a retaining element 34. As can be seen in FIG. 15, the two retaining elements 34 can laterally be pushed onto the magnetic device 2 for the purpose of mounting. The retaining elements 34 can be mounted on the magnetic device 2 in frictional engagement therewith by means of headless screws 35 which are screwed into respective tapped holes 36. The two retaining devices 12, together with the connection plates 32 and 33, enclose the end sections of the magnetic device 2 in a substantially U-shaped configuration.

Figure 16:
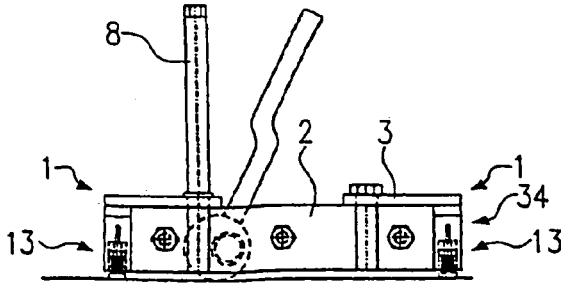
FIG. 16 shows a fifth embodiment of the positioning aid in a representation corresponding to that of FIG. 1.
Figure 17:
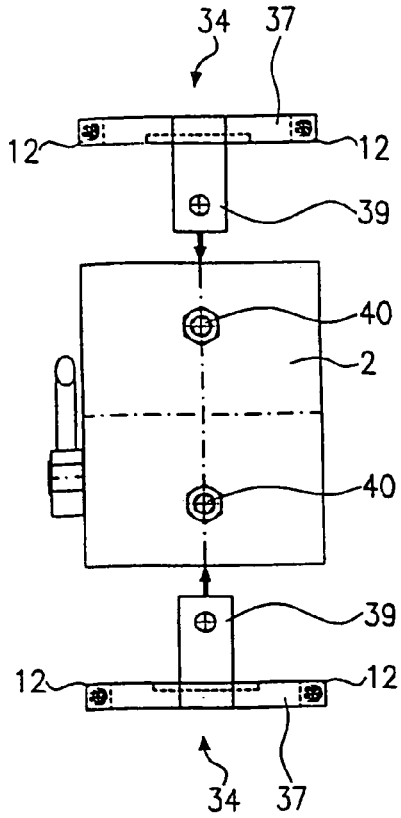
FIG. 17 shows the positioning aid of FIG. 16 in a mounting representation.

FIGS. 16 and 17 show a fifth embodiment, which is provided with retaining elements 34 as well, but in the case of which the connection plates are replaced by retaining bridges 37 which interconnect two respective retaining devices 12. An additional mounting plate 38 extends on the upper side 5 of the magnetic device 2 along a certain section thereof and can be connected to the magnetic device 2 via a hole 39 and a screw 40. Said screw 40 is located on the upper side 5 of the magnetic device 2. Due to the structural design of the retaining bridge 37 and of the retaining devices 12, the retaining element 34 is in large-area contact with the associated side face 6 of the magnetic device 2.

Also in this case compression springs are used as spring elements.

Figure 18:
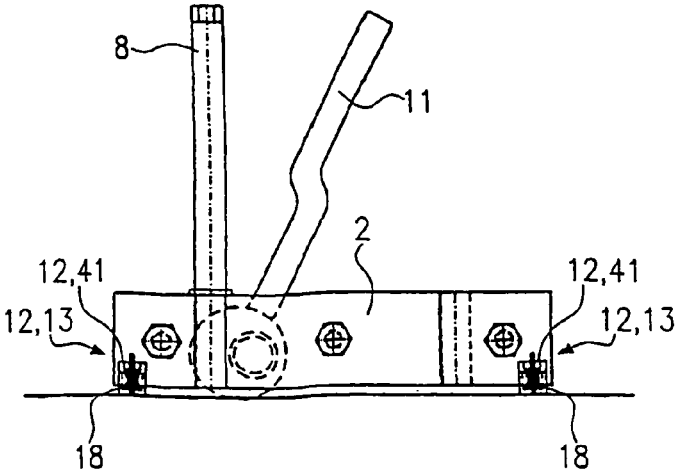
FIG. 18 shows a sixth embodiment of a positioning aid according to the representation in FIG. 1.
Figure 19:
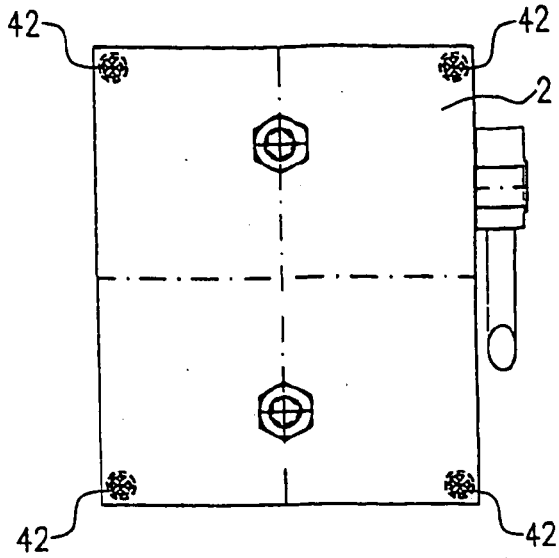
FIG. 19 shows the embodiment of FIG. 18 in a top view.

FIGS. 18 and 19 represent a sixth embodiment of the present invention. In this embodiment, the retaining device 12 is integrated in the magnetic device 2. It is formed by blind holes 41 accommodating the respective support units 13. This leads to a further compact structural design of the combination of magnetic device and positioning aid. If a magnetic device having a layered structure is used, it will, alternatively, be imaginable to partially break through one of the layers extending vertically and in the longitudinal direction, so as to form reception means for the support unit.

Figure 20:
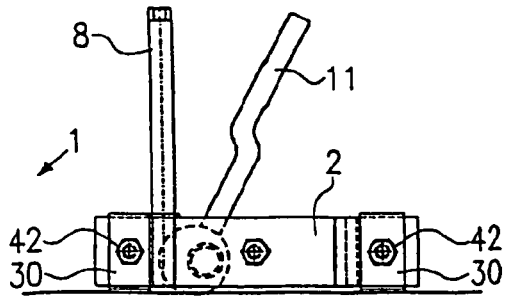
FIG. 20 shows a seventh embodiment of the positioning aid according to the present invention in a representation corresponding to that of FIG. 1.
Figure 21:
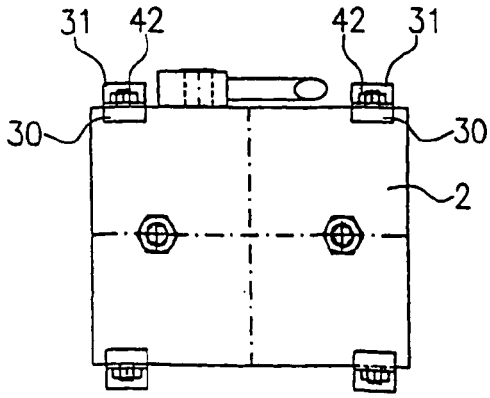
FIG. 21 shows a top view of the positioning aid of FIG. 20.
Figure 22:
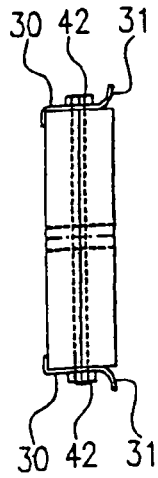
FIG. 22 shows a side view of the positioning aid of FIG. 20.

FIGS. 20, 21 and 22 discloses a seventh embodiment of the present invention whose mode of operation corresponds essentially to that of the third embodiment. Also this embodiment is provided with spring steel sheets 30. The components used in this embodiment as a retaining element are, however, screws 42 by means of which the spring steel sheets are mounted on the magnetic device 2.

Figure 23:
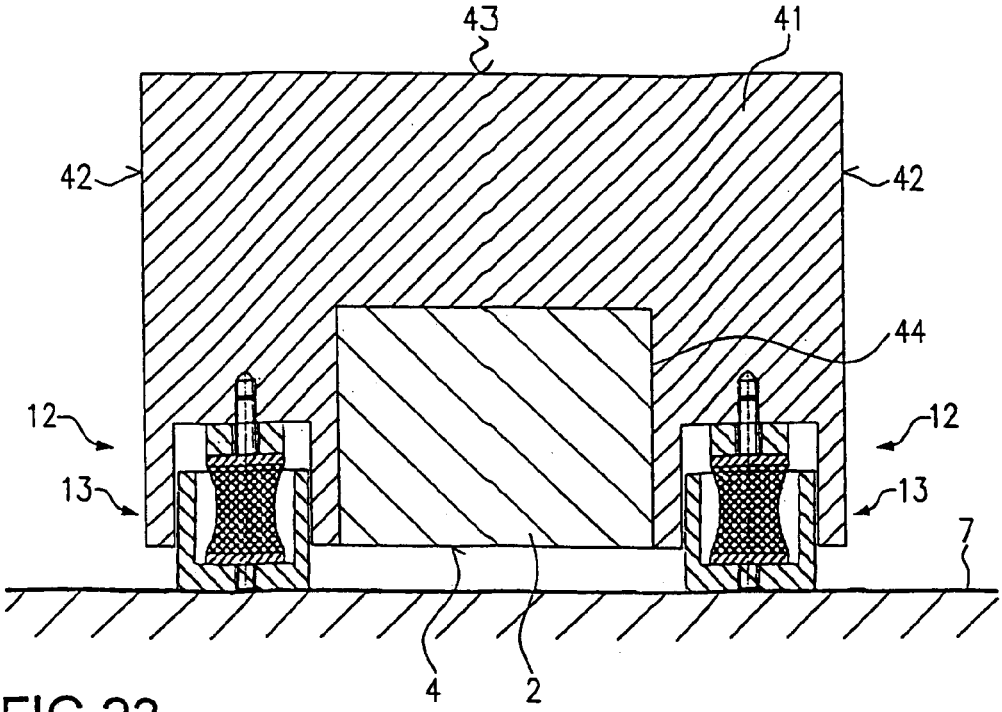
FIG. 23 shows an eighth embodiment of the positioning aid according to the present invention, the positioning aid being integrated in a shuttering means and the positioning aid occupying the position of non-use.
Figure 24:
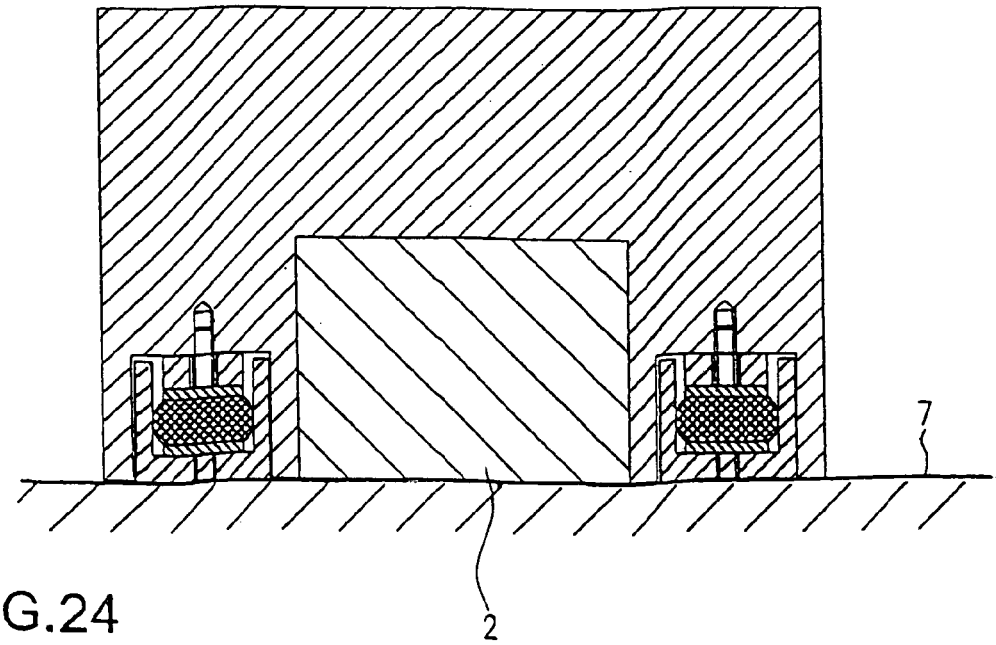
FIG. 24 shows the embodiment of FIG. 23 at the position of use.

FIGS. 23 and 24 show an eighth embodiment of the present invention. In this embodiment, a plurality of retaining devices is formed integrally with a shuttering means 41. The representation in FIG. 23 is a sectional view in which two of the retaining elements can be seen. The shuttering means has essentially the shape of a parallelepiped comprising shuttering side faces 42 and a top side 43 which interconnects the two shuttering side faces 42. The magnetic device 2 is accommodated in a magnet reception means 44. In the embodiment shown, the magnetic device 2 is fixed to the magnet reception means 44 by means of an adhesive. The bottom side 4 of the magnetic device 2 is flush with the retaining devices and the shuttering means 41, respectively. The structural design of the support units 13 corresponds e.g. to the structural design in the case of the first embodiment. The alternatively described embodiments can be used as well.

At the position of use, the bottom side 4 of the magnetic device 2 and the retaining devices and the shuttering means, respectively, rest on the shuttering support. It follows that, at the position of non-use, the shuttering means is only supported via the support units 13. This has the effect that the shuttering side faces 42 are spaced apart from the shuttering support. In the embodiment described, e.g. four support units can be provided at each corner of the shuttering means which has essentially the shape of a parallelepiped. The shuttering means can thus be moved easily and rapidly to the desired position. When the desired position has been reached, the shuttering means will be lowered together with the magnetic device, which is fixedly retained in the shuttering means. Hence, also the shuttering side faces will rest on the shuttering support at the position of use. For releasing the shuttering means, a lift-off means, which is not shown and which may e.g. be an eccentric, can be provided. This eccentric can project e.g. centrally from the bottom side 4 of the magnetic device 2 and it can operable in the manner known via a lever extending through the shuttering means. It is thus possible to use both shuttering side faces 42 for producing respective shutterings.

Figure 25:
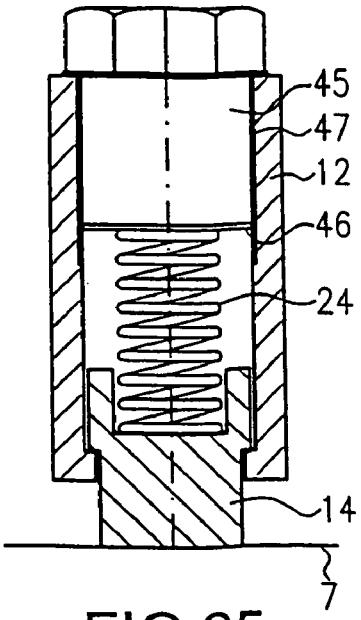
FIG. 25 shows a further embodiment of the retaining device and of the support unit in an enlarged representation according to FIG. 1, at the position of non-use.
Figure 26:
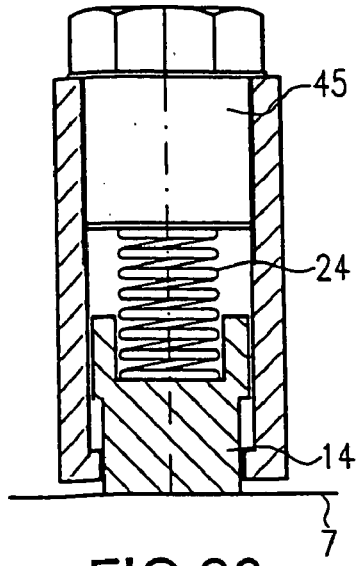
FIG. 26 shows that representation of FIG. 25 at the position of use.

FIGS. 25 and 26 show enlarged representations of a retaining device and of a support unit of the type used e.g. in an embodiment according to FIG. 1. An adjusting screw 45 is here additionally provided whose bottom side 46 is fixed to the spring 24 by means of an adhesive. The adjusting screw 45 is rotatably and adjustably received in an adjusting thread 47. By rotating the adjusting screw, the pretension of the spring 24 can be varied. For this purpose, the rest-on means 14 is again captively accommodated in the retaining device. By rotating the adjusting screw 45, the distance between the bottom side of the adjusting screw 45 and the rest-on surface can be varied so that the pretension of the spring 24 will change. In the representation in FIG. 26, it can easily be seen that a small gap between the retaining device and the shuttering support remains at the position of use. Since the magnetic device rests fully on the shuttering support, a redundancy in determination of the contact between the magnet and the retaining device can be avoided.

Figure 27:
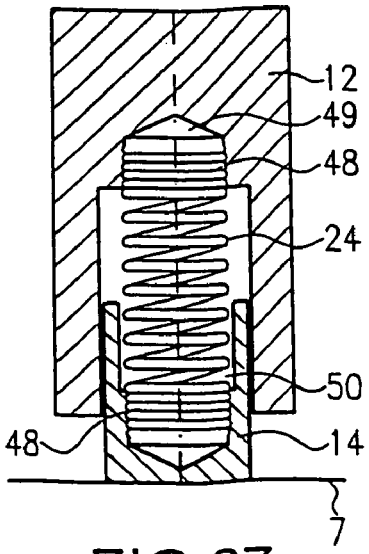
FIG. 27 shows a further embodiment of the retaining device and of the support unit at the position of non-use in a representation according to FIG. 25.
Figure 28:
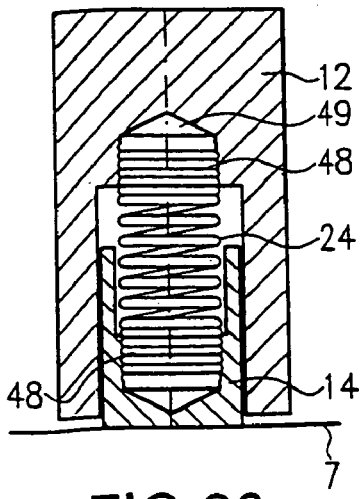
FIG. 28 shows the retaining device and the support unit of FIG. 27 at the position of use.

FIGS. 27 and 28 show a further embodiment of the retaining device and of the support unit in accordance with the representation shown in FIGS. 25 and 26. In the case of this embodiment, the spring 24 is provided with threaded portions 48 at the respective ends thereof, said threaded portions 48 being screwed into threads 49 and 50 in the retaining device and in the rest-on means 14. By rotating the rest-on means 14, it is again possible to vary the distance between the rest-on means 14 and the retaining device 12 and thus the pretension of the spring.

The invention claimed is:

1. A positioning aid for a magnetic device used for positioning at least one of a shuttering means and shuttering elements, the magnetic device being movable between a position of use, in which said magnetic device is in contact with a ferromagnetic shuttering support, and a position of non-use, in which said magnetic device is spaced apart from the shuttering support, said positioning aid comprising at least one retaining device relative to which the magnetic device is supported against a holding force of said magnetic device, and further comprising at least one resilient support unit for producing a lifting force against said holding force so as to hold the magnetic device in the position of non-use, wherein the magnetic device is firmly connected to the retaining device and that, at least in the position of non-use, the support unit is arranged between the retaining device and the shuttering support, at least along certain sections thereof.

2. A positioning aid according to claim 1, wherein at least two spaced-apart retaining devices are provided, which each have associated therewith one support unit.

3. A positioning aid according to claim 2, wherein the retaining devices are arranged on opposed sides of the magnetic device.

4. A positioning aid according to claim 2, wherein four retaining devices are provided.

5. A positioning aid according to claim 1, wherein the retaining device comprises one of two respective retaining devices associated with one side of the magnetic device.

6. A positioning aid according to claim 1, wherein the retaining device comprises one of a plurality of retaining devices that are interconnected such that they are adapted to be moved to spaced-apart positions via associated adjusting means.

7. A positioning aid according to claim 1, wherein the retaining device comprises a first retaining device rigidly interconnected to a second retaining device.

8. A positioning aid according to claim 6, wherein the retaining devices, together with the adjusting means, form a holding frame which surrounds the magnetic device.

9. A positioning aid according to claim 1, wherein the retaining device is releasably connected to the magnetic device.

10. A positioning aid according to claim 1, wherein the magnetic device has essentially the shape of a parallelepiped and a bottom side thereof faces the shuttering support.

11. A positioning aid according to claim 1, wherein the retaining device is adapted to be attached to one of the side faces of the magnetic device.

12. A positioning aid according to claim 1, wherein the retaining device is attached to an upper side of the magnetic device, said upper side facing away from the shuttering support.

13. A positioning aid according to claim 1, wherein the retaining device includes a reception means which is engaged by the magnetic device.

14. A positioning aid according to claim 13, wherein the magnetic device is adapted to be inserted into said reception means.

15. A positioning aid according to claim 1, wherein the retaining device is attached to the magnetic device by a screw connection.

16. A positioning aid according to claim 1, wherein a lift-off means is provided with the aid of which the magnetic device can be transferred from its position of use to its position of non-use.

17. A positioning aid according to claim 16, wherein the lift-off means is attached to the magnetic device.

18. A positioning aid according to claim 16, wherein the lift-off means is provided with an eccentric which is adapted to be brought into engagement with the shuttering support, so as to effect a movement from the position of use to the position of non-use.

19. A positioning aid according to claim 18, wherein a lever is provided for operating the lift-off means.

20. A positioning aid according to claim 19, wherein the lever and the eccentric are firmly interconnected and rotatably supported on the magnetic device.

21. A positioning aid according to claim 18, wherein the eccentric is arranged such that it is located closer to one side of the magnetic device than to the side located opposite said first-mentioned side.

22. A positioning aid according to claim 1, wherein the support unit is provided with an elastic spring element for producing the lifting force.

23. A positioning aid according to claim 22, wherein the elastic spring element is a compression spring.

24. A positioning aid according to claim 22, wherein the elastic spring element comprises an elastomer.

25. A positioning aid according to claim 22, wherein the elastic spring element is a rubber element.

26. A positioning aid according to claim 22, wherein the elastic spring element is a plastic spring.

27. A positioning aid according to claim 22, wherein the elastic spring element is a bending sheet whose end portion is adapted to be deflected by sliding on the shuttering support during the transfer movement.

28. A positioning aid according to claim 22, wherein the support unit includes a rest-on means, which is displaceably supported in the retaining device and which rests on the shuttering support at least at the position of non-use, the spring element being accommodated between the rest-on means and the retaining device.

29. A positioning aid according to claim 28, wherein the rest-on means is substantially pot shaped and that the reception means of the retaining device has the shape of a cylinder jacket.

30. A positioning aid according to claim 28, wherein the rest-on means is captively connected to the retaining device.

31. A positioning aid according to claim 22, wherein the spring force of the spring element is adjustable.

32. A positioning aid according to claim 31, wherein an adjusting screw is provided for adjusting the spring force.

33. A positioning aid according to claim 32, wherein the spring element is provided with an adjusting thread.

34. A positioning aid according to claim 1, wherein the retaining device is integrated in the magnetic device.

35. A positioning aid according to claim 24, wherein the retaining device is formed by holes in the magnetic device.

36. A positioning aid according to claim 1, wherein the retaining device is connected to the magnetic device by an adhesive.

* * * * *